United States Patent [19]

Flick

[11] 4,227,615

[45] Oct. 14, 1980

[54] MEDICINE CONTAINER

[76] Inventor: Gervase M. Flick, Apt. 3D, Lagoon Apts., Hilton Hawaiian Village Hotel, Honolulu, Hi. 96815

[21] Appl. No.: 35,287

[22] Filed: May 2, 1979

[51] Int. Cl.[3] ..... B65D 55/02

[52] U.S. Cl. ..... 215/222; 215/1 C; 215/1 R; 206/45.34; 206/540; 200/82R

[58] Field of Search ..... 215/222, 1 R, 1 C, 203, 215/365; 206/45.34, 540; 220/82 R

[56] References Cited

U.S. PATENT DOCUMENTS

| | | | |
|---|---|---|---|
| 2,549,681 | 4/1951 | Goldstaul | 220/82 R X |
| 3,643,831 | 2/1972 | Casper | 206/45.34 |
| 3,977,551 | 8/1976 | Ciarico | 220/82 R X |

*Primary Examiner*—George T. Hall

*Attorney, Agent, or Firm*—Oldham, Oldham, Hudak & Weber

[57] ABSTRACT

A medicine container of opaque or translucent material is provided with an aperture to allow one to clearly view the contents of the container. In one embodiment of the invention, the container is characterized by a transparent window in the cylindrical side wall thereof, while two other embodiments provide for a transparent bottom to the container.

7 Claims, 4 Drawing Figures

MEDICINE CONTAINER

BACKGROUND OF THE INVENTION

The invention resides in the art of closures or containers, and more particularly in the area of medicine bottles or containers having safety features associated therewith.

In the past, pharmacists would individually count and package the medicine for each of their customers at the moment and point of sale, each customer getting individual and personalized attention. Thus, with the customer before him and with the prescription in hand, the pharmacist would count the pills, capsules, or the like which were prescribed, from a large mass container into the small container to be ultimately given to the customer. Additionally, this smaller container was generally transparent, such that while the pharmacist was measuring out the amount of medicine to be dispensed, right up to the point of handing the transparent container to the customer, the pharmacist could visually apprise himself of the type of medicine being dispensed to satisfy himself that such medicine was that prescribed.

However, in recent years, skyrocketing medical costs, including the cost of medicines, have pressed the pharmaceutical industry, from the manufacturer to the pharmacist, into practices which have eliminated a number of previously practiced safeguards, increasing the potential of a patient receiving medicine other than that prescribed.

Today, many pharmacists prepackage their more common medication in bottles of 30, 50, 100, or any of the commonly prescribed number. This is done during the pharmacist's "slow" hours, so that during busier hours of the day the pharmacist will not have to count out the number of pills or capsules prescribed while the patient is actually present with his prescription. Accordingly, the medication handed the patient frequently is not examined and counted with that particular patient and his prescription in mind, but is counted, identified, and prepackaged weeks before. Thus, the safety factor of having the pharmacist fill the patient's small bottle from a larger mass bottle, with the patient and his prescription right at hand, is now lost.

Today, pharmaceuticals are often dispensed in dark brown bottles, rather than the clear bottles of days gone by. The dark color of these bottles, either of glass or plastic, acts as a light filter to protect those medications which lose their potency when subjected to light. The use of such bottles has resulted in the loss of yet another safety factor in that these translucent or substantially opaque pill bottles prevent the pharmacist from identifying the exact color, shape, and type of medication within the bottle. Formerly, just before handing the patient the bottle, the pharmacist could look through the clear glass or plastic and be certain that the size, shape, and color of the medicine dispensed was in accordance with the prescription. However, the dark brown pill bottles presently used prevent such final inspection.

The pharmaceutical industry is now using safety top pill bottles as child-proof containers. While the advent of such bottles has probably saved numerous lives, they have presented a problem in that many adults find them difficult to open and even some pharmacists may have a problem late in the day when their hands may be tired from opening and checking several hundred such bottles. Accordingly, a third safety factor is lost in that the pharmacist, who can no longer see through the clear bottle, and who used to open the brown bottle without a safety top just before handing it to the patient to do a final check of medicine identification, may no longer bother to open the more difficult child-proof top of the brown bottle.

Finally, in the past, pharmacies kept their shelf drugs stored by classification of the drug. For example, antibodies were maintained in one place, diuretics in another place, analgesics in still another place, and so forth. Thus, when a patient received the wrong medicine by mistake, it was generally at least in the correct classification of drugs, and the mistake may have been nothing more than the selection of a different brand name than prescribed. However, many pharmacists have now inventoried their drugs alphabetically. With such alphabetical storage of drugs, if a pharmacist grasps the wrong prepackaged medication, he most likely will hand the patient a drug completely different from that intended, a drug which could indeed be totally contrary to that prescribed. For example, in an instance known to applicant, when Diabinese (a hypoglycemic agent) was given to an epileptic instead of Dilantin (an anti-seizure agent), death resulted.

The foregoing is not an exhaustive list of the erosion of safety factors present in the pharmaceutical industry. While such erosion has often been the result of advances in the art, it is nonetheless necessary to regain the safety factor of point of sale review and inspection of medicine by the pharmacist.

OBJECTS OF THE INVENTION

In light of the foregoing, it is an object of the instant invention to provide a medicine container which may be constructed of an opaque, light-filtering material while providing means for viewing the contents of the container.

Another object of the invention is to provide a medicine container wherein the container is substantially opaque, having an area through which the user may view the contents of the container, which area is, in normal use, protected from light.

Still another object of the invention is to provide a medicine container which allows the dispensing agent to make a final review and inspection of the medicine within the container prior to delivery of the container to the patient, such inspection being made without opening the container.

Yet an additional object of the invention is to provide a medicine container which achieves the foregoing objects and which is simplistic in nature, inexpensive to construct, and easy to use.

SUMMARY OF THE INVENTION

The foregoing and other objects of the invention which will become apparent as the detailed description proceeds are achieved by a container for safely receiving and storing medication, comprising: a body portion having a mouth at a top end thereof, and a bottom connected to said body portion opposite said mouth, said body portion being substantially opaque and wherein said bottom is transparent.

DESCRIPTION OF DRAWING

For a complete understanding of the objects, techniques, and structure of the invention, reference should be had to the following detailed description and accompanying drawing, wherein.

DETAILED DESCRIPTION OF PREFERRED EMBODIMENTS

Figure 1:
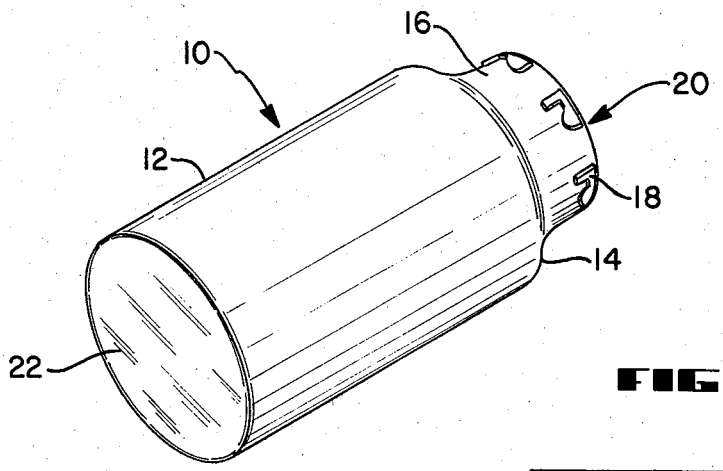
FIG. 1 is a perspective view of an embodiment of the invention wherein the container has a transparent bottom.

Referring now to the drawing and more particularly FIG. 1, it can be seen that a first embodiment of the medicine container is designated generally by the numeral 10. The container 10 may be constructed of glass, plastic, or the like, and the bottle proper is defined particularly by the cylindrical body portion 12. As is now common practice, the body portion 12 would either be smoke, dark brown, or of other suitable coloration to effect light filtration. The specifics of such filtration have now become a widely accepted part of the art and are not elaborated upon herein.

The cylindrical body portion 12 tapers at the shoulder 14 to form a neck 16 of reduced diameter. The neck 16 is characterized by threads 18 for receiving a cap, not shown. Preferably, the cap would be a safety cap having some type of actuation means for engaging the cap threads with the lock threads 18 only upon some overt action by the user. In any event, the cap is used to seal a mouth 20 through which medication is deposited into or removed from the container 10.

Opposite the mouth 20 is a bottom 22 which is preferably made of a clear plastic material. The bottom 22 may be molded as part and parcel of the container 10 or may be affixed to the cylindrical body portion 12 by appropriate cementing techniques. Regardless of the method by which the transparent bottom 22 is affixed to the body portion 12, such construction allows a pharmacist to turn the bottle upside down and view the contents thereof through the bottom 22 without the necessity of removing the safety cap. Further, with the clear plastic being at the bottom of the container 10, light does not enter the container when it is standing on its bottom since the supportive surface serves as a light barrier.

Figure 2:
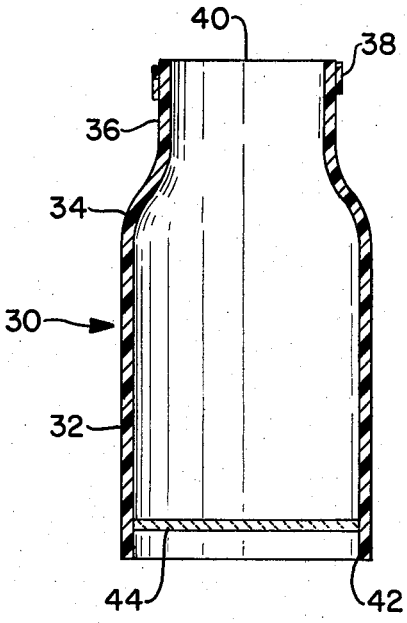
FIG. 2 is a cross-sectional view of a second embodiment of the invention showing the container having a recessed transparent bottom.

With reference to FIG. 2, it can be seen that another bottle according to the teachings of the instant invention is designated by the numeral 30. Again, a cylindrical body portion 32 is provided to define the size, contour, and volume of the container proper. The body portion 32 tapers at shoulders 34 to form a reduced diameter neck 36. Again, lock threads 38 are provided for receiving a cap which is preferably of the safety cap type. The mouth 40 is sealed by the cap to provide a means for depositing medicine into and withdrawing the same from the container 30. In this embodiment of the invention, however, a rim or flange 42 is defined by an extension of the body portion 32 with the clear plastic bottom 44 being recessed within the flange. In this embodiment, with the body portion 32 being of a light-filtering plastic or glass, the pharmacist may again view the medicine at the point of sale by merely turning the bottle upside down and looking through the clear or transparent bottom portion 44. With the flange 32 extending beyond the bottom 44, further shielding against light is provided. In this embodiment, there are no transparent areas at the bottom of the container 30, but such transparency is provided at a point above the bottom, such that the entrance of light into the container at the area of interconnection between the body portion 32 and bottom 44 is prevented.

Figure 3:
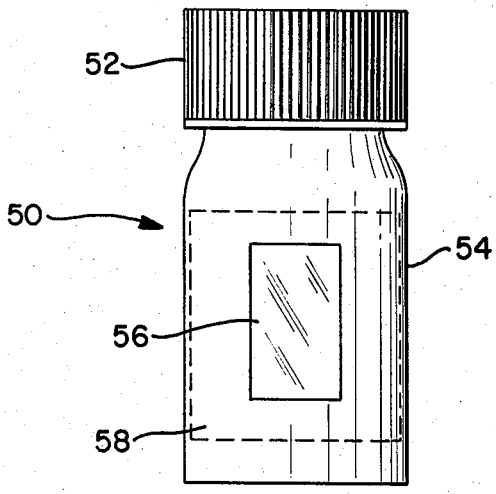
FIG. 3 is a front plan view of a third embodiment of the invention having a transparent window.

Yet another embodiment of the invention is shown in FIG. 3 as the bottle 50. The bottle is sealed by means of a safety cap 52 which may be of any standard, suitable nature. The entire container 50, including the cylindrical body 54 and the bottom thereof are molded of a light-filtering glass or plastic to have the appearance of the dark brown pill bottles presently known in the art. However, a window 56 of transparent material, preferably clear plastic or glass, is provided in the side of the cylindrical body portion 54 to allow the pharmacist to view the contents of the container therethrough. The window 56 may be molded or otherwise adhesively secured within the body 54 utilizing any of numerous techniques which will be readily conceivable to one skilled in the art.

The window 56 is axially positioned midway along the body portion 54 in such an area that the same will be covered by a label 58, shown in phantom, at the time the container 50 is delivered to the patient or customer. The label 58 would preferably be of a light-impervious material so as to totally seal the window 56 and inhibit light from entering therein. The window 56 would, however, allow the pharmacist to view the medication within the container at the time the label 58 is being prepared with the patient's name, prescription, and dosage information listed thereon. Accordingly, a check of the medication is made with the particular patient and prescription in mind, at the point of sale.

Figure 4:
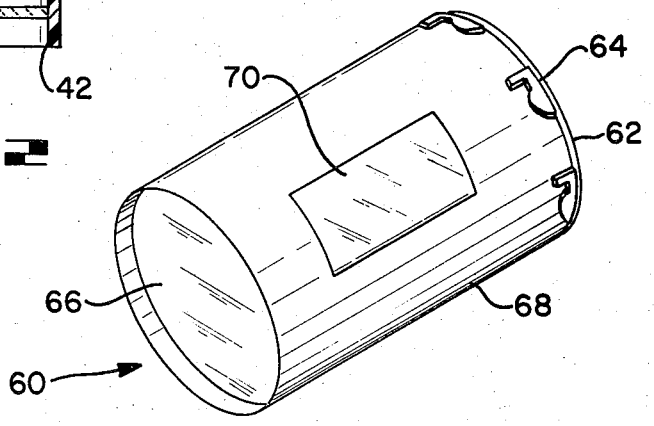
FIG. 4 is a perspective view of a container different from those of FIGS. 1–3, yet including features of the invention.

It will be appreciated that the invention may be adapted for use with any of a number of container configurations. For example, the medicine bottle of FIG. 4, being of uniform diameter and not having a reduced neck size, can be readily provided with the advantages of the invention. As shown, the container 60 has lock threads 62 about the mouth 64 thereof and may be provided with a transparent bottom 66. The bottom 66 may be recessed with respect to the body portion 68, or the body portion 68 may be provided with a transparent window 70. The benefits and advantages of the invention may be achieved utilizing any of the foregoing combinations.

Thus, it can be seen that the objects of the invention have been satisfied by the structure presented hereinabove. Various embodiments of medicine containers have been presented which allow a pharmacist to make a final inspection of prepackaged medications at the point of sale and to make such inspection without opening the container itself. While only the best mode and preferred embodiments of the invention presently contemplated by applicant have been presented and described in detail, it is to be understood that the invention is not limited thereto or thereby. Accordingly, for a complete understanding of the scope and breadth of the invention, reference should be had to the appended claims.

What is claimed is:

1. A container for safely receiving and storing medication, comprising:

a body portion having a mouth at a top end thereof and a bottom connected to said body portion opposite said mouth, said body portion being substantially opaque and said bottom being transparent and recessed within said body portion and being completely encompassed about the periphery thereof by said body portion.

2. The container for medication according to claim 1 wherein said body portion is constructed of a light filtering material.

3. The container for medication according to claim 1 wherein said mouth is selectively sealed by a safety cap having means therein for selective engagement with threads maintained about said top end.

4. A container for medicines, comprising:

a cylindrical body portion of substantially opaque material and sealed by a bottom at one end thereof, said body portion being characterized by a transparent window therein, said window being covered by a light-impervious label.

5. The container for medicines as recited in claim 4 wherein said transparent window is longitudinally centrally positioned upon said body portion.

6. The container for medicines as recited in claim 5 wherein said label is impervious to light.

7. The container for medicines as recited in claim 4 wherein said body portion has a mouth closed by a safety cap threaded thereto, said cap having thread actuation means for allowing threads of the cap to selectively engage threads about a mouth of the container.

* * * * *